US007716947B2

(12) United States Patent
Brandon et al.

(10) Patent No.: US 7,716,947 B2
(45) Date of Patent: May 18, 2010

(54) APPARATUS AND METHOD FOR CONDENSING HYDROCARBONS FROM NATURAL GAS

(75) Inventors: Mark A. Brandon, Whitehouse, TX (US); Calvin Cain, Whitehouse, TX (US); Bruce Primrose, Tyler, TX (US)

(73) Assignee: Gas-Chill, Inc., Tyler, TX (US)

( * ) Notice: Subject to any disclaimer, the term of this patent is extended or adjusted under 35 U.S.C. 154(b) by 621 days.

(21) Appl. No.: 11/544,249

(22) Filed: Oct. 6, 2006

(65) Prior Publication Data

US 2007/0079630 A1 Apr. 12, 2007

Related U.S. Application Data

(60) Provisional application No. 60/724,998, filed on Oct. 7, 2005.

(51) Int. Cl.
*F25J 3/00* (2006.01)
*B01D 50/00* (2006.01)
*F28D 7/00* (2006.01)

(52) U.S. Cl. ..... 62/620; 62/617; 165/159; 55/325

(58) Field of Classification Search ..... 62/617, 62/620; 165/159, 141; 55/325
See application file for complete search history.

(56) References Cited

U.S. PATENT DOCUMENTS 1,020,103 A * 3/1912 Von Linde ..... 62/620
4,089,370 A * 5/1978 Marchal ..... 165/159
4,090,554 A * 5/1978 Dickinson ..... 165/11.1
4,504,292 A * 3/1985 Vohringer ..... 55/325
4,638,852 A * 1/1987 Basseen et al. ..... 165/47
5,048,557 A * 9/1991 Campau ..... 137/386
5,048,597 A * 9/1991 Bond ..... 165/41
5,107,919 A * 4/1992 Basseen et al. ..... 165/47
6,564,579 B1 * 5/2003 McCartney ..... 62/620

* cited by examiner

*Primary Examiner*—Frantz Jules
*Assistant Examiner*—Cassey Bauer
(74) *Attorney, Agent, or Firm*—Hugh R. Kress

(57) ABSTRACT

Apparatus for condensing hydrocarbons, such as but not limited to butane and propane, from a stream of natural gas includes as its primary components a pre-cooler assembly, a chiller assembly, a refrigerant compressor/condenser assembly, and separator assembly. In the pre-cooler assembly warm gas entering the apparatus is cooled by counter-current flow heat exchange with cooled natural gas exiting the apparatus. The chiller assembly of the apparatus the hydrocarbon stream is cooled in co-current flow heat exchange with a first refrigerant tube, carrying a first refrigerant which is itself cooled in co-current heat exchange with a second refrigerant tube disposed in coaxial relationship with the first refrigerant tube. Both first and second refrigerant tubes are disposed in coaxial relationship with an outer jacket conveying the gas stream through the chiller assembly. Condensed hydrocarbons are separated from the gas stream in the separator assembly.

18 Claims, 5 Drawing Sheets

APPARATUS AND METHOD FOR CONDENSING HYDROCARBONS FROM NATURAL GAS

RELATED DATA APPLICATION

This application claims the benefits of U.S. Provisional Patent Application Ser. No. 60/724,998, filed Oct. 7, 2005.

FIELD OF THE INVENTION

The present invention generally relates to the extraction of hydrocarbons from natural gas, and in its preferred embodiments more specifically relates to apparatus and methods for condensing hydrocarbons from natural gas by indirect heat exchange with a refrigerant.

BACKGROUND OF THE INVENTION

Natural gas is commonly considered to consist of methane, but the gas produced from a well normally contains higher hydrocarbons such as propane and butane. Those hydrocarbons are in gaseous form when the gas is collected from the well, but because of their higher boiling points are more readily condensed to liquids. It is desirable to remove higher hydrocarbons from the methane before the natural gas is introduced into high pressure pipelines to prevent condensate from forming in the pipeline and in associated equipment during transport. Those hydrocarbons also have economic value to the well owner or operator.

Approaches known in the prior art for removing higher hydrocarbons from methane at the wellhead include expansion of the produced gas, and the use of refrigerant, to cool the gas and condense some of the higher hydrocarbons. Although these approaches do result in removal of some of the higher hydrocarbons from the predominantly methane stream, their effectiveness is limited because of limitations of the temperature drop that can be achieved.

There remains a need for an efficient and effective process and apparatus for removing hydrocarbons such as propane and butane from a natural gas stream at the wellhead.

SUMMARY OF THE INVENTION

The present invention provides a method of and apparatus for removing hydrocarbon liquids from natural gas streams to control the hydrocarbon dewpoint of gas upstream of transmission pipelines. The method and apparatus utilize a highly effective refrigeration system, and in the preferred embodiment the apparatus is constructed and provided as modular units for ease of transport and installation. Though the scope of the invention is not limited in either minimum or maximum capacity, the apparatus of the invention is known to be commercially feasible and economically effective for processing gas volumes ranging from 50 mcfg/day to 1,000 mcfg/day. The apparatus is capable of achieving temperatures of −20° F. using commercially available refrigerants, and at operating pressures ranging from ambient to at least 1,000 psig.

In the process or method of the invention the incoming gas stream enters a pre-cooler heat exchanger, where the gas stream is pre-cooled by cold outlet gas. The gas stream passes through a chiller section where the temperature of the gas stream is lowered to that required to condense the designated hydrocarbons from the gas by indirect contact with refrigerant. The chiller section utilizes a unique dual refrigerant design, in which a first, super-cooled, refrigerant line is disposed within a second refrigerant line. The second refrigerant line is disposed within the gas piping, so that the gas is in heat exchange contact with the second refrigerant line, and the refrigerant flowing through the second line is in heat exchange contact with the first refrigerant line. From the chiller section the gas and condensed vapors next flow into a separator unit, where the condensed hydrocarbons are collected. The gas, free of the liquid hydrocarbons, flows from the separator unit, passes through the pre-cooler, and exits the apparatus. The recovered hydrocarbon liquids flow, or are pumped, from the bottom of the separator to storage.

The apparatus of the invention and the method of the invention will be described in more detail with reference to the accompany drawing figures.

DESCRIPTION OF THE INVENTION

Figure 1:
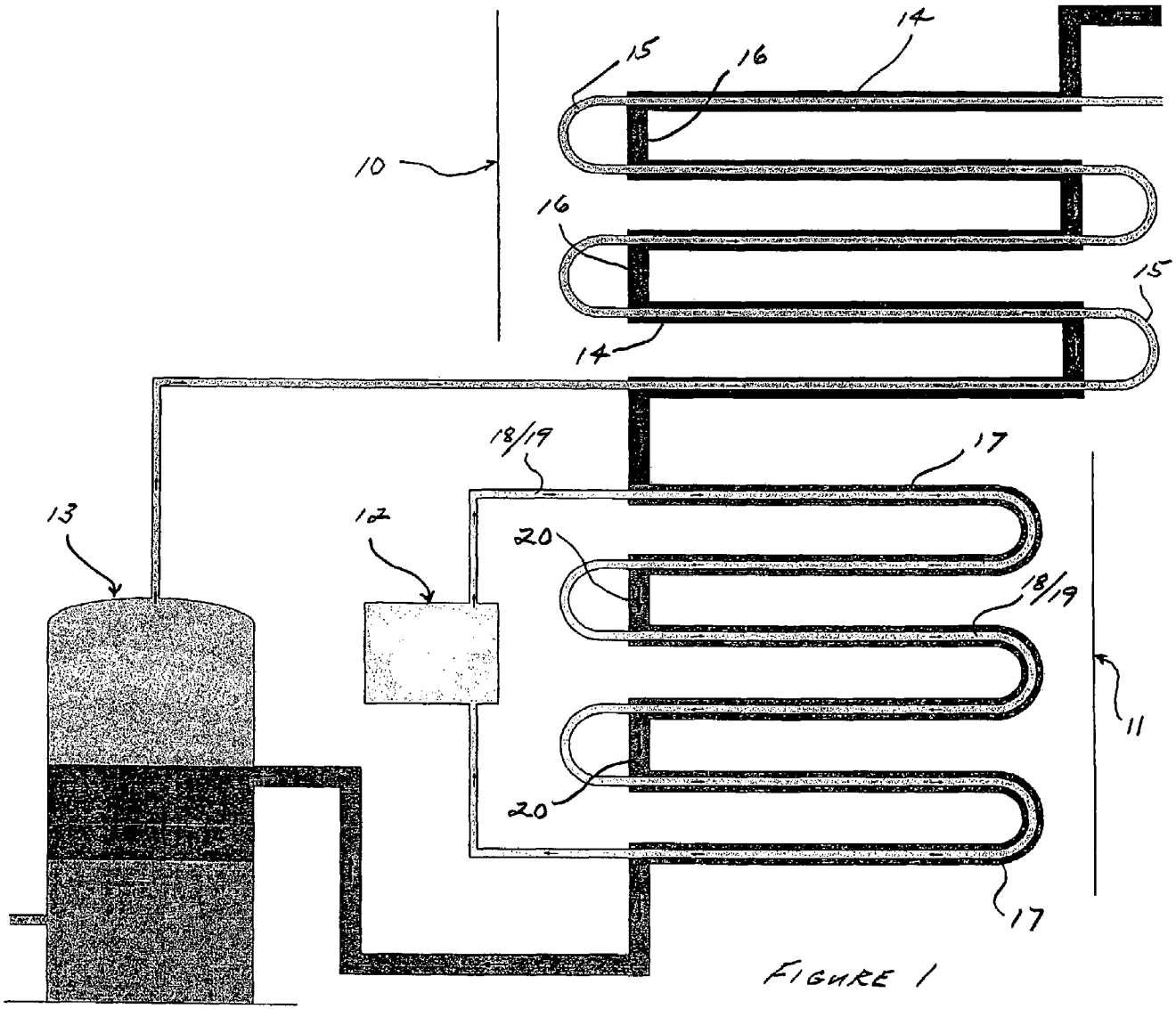
FIG. 1 is a schematic illustration of a preferred embodiment of the apparatus of the invention and a flow diagram showing fluid flows through the apparatus in accordance with the method of the invention.

In the preferred embodiment the basic components of the apparatus of the invention include a pre-cooler assembly 10, a chiller assembly 11, at least one refrigerant compressor/condenser assembly 12, and separator assembly 13, with associated conduits and piping for routing gas, liquid, and refrigerant streams, and associated controls.

Pre-cooler assembly 10 is a heat exchanger in which heat is transferred from the warm gas stream entering the apparatus to the cooled gas stream exiting the apparatus. The gas streams are in countercurrent flow through the pre-cooler, which is structured with outerjackets 14 and an inner tube or pipe 15 of smaller diameter, extending coaxially through the interior of jackets 14. In the preferred embodiment the warm gas stream flows through jackets 14 and the cooled gas stream flows through pipe 15, but the routing of the gas streams through the pre-cooler is not critical, because the volume of the warm gas is greater than the volume of the cooled gas exiting the apparatus. The diameter of jackets 14 and the diameter of pipe 15 are selected to accommodate the gas volume and flow rates through the system.

Figure 2:
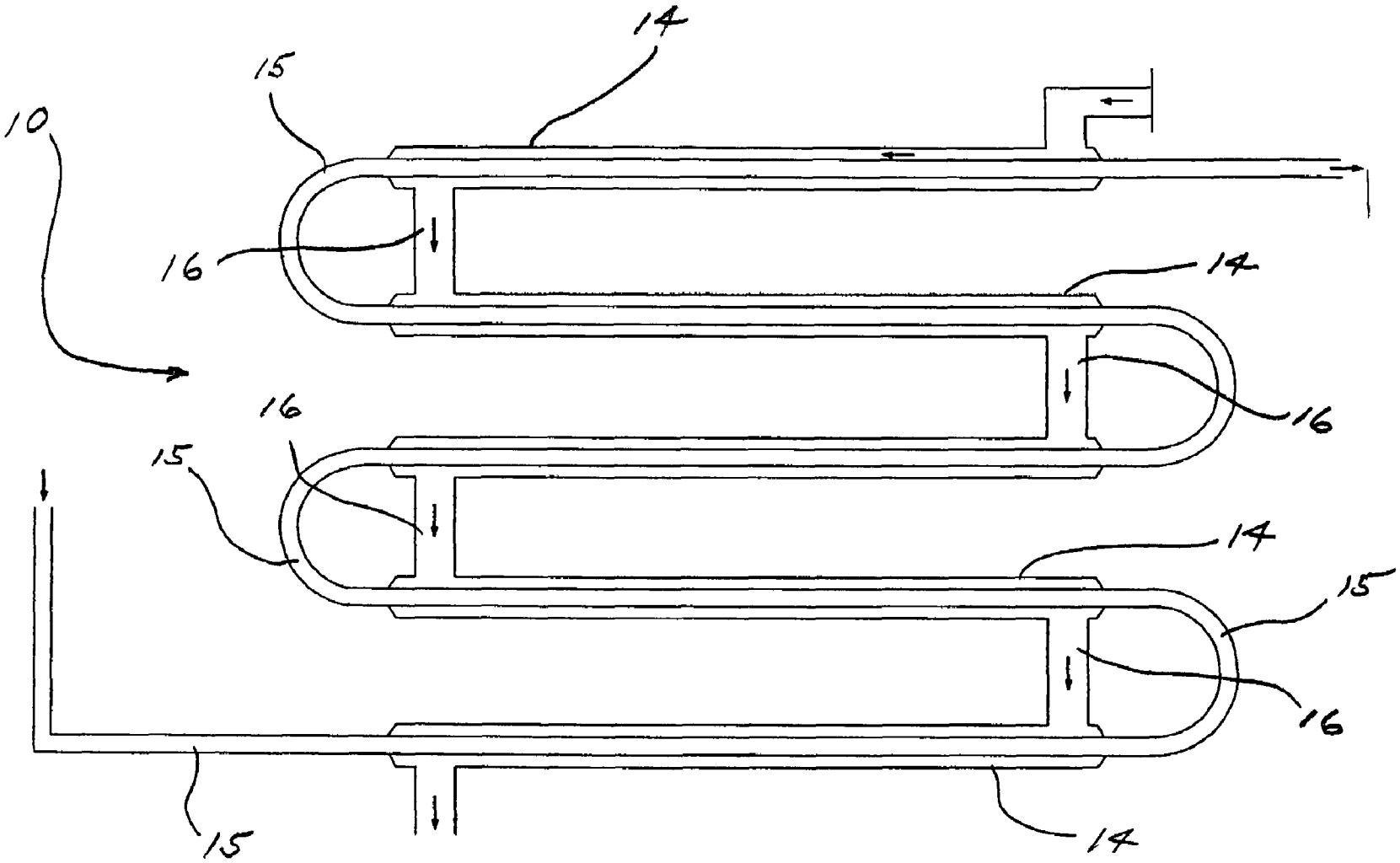
FIG. 2 is a schematic illustration of a preferred embodiment of the pre-cooler assembly of the apparatus of the invention.

In the preferred embodiment a plurality of jackets 14 are staged in a compact stacked orientation, as shown in FIG. 2, connected by short connector conduits 16. Pipe 15 preferably extends continuously in a sinuous curve through the stacked series of jackets. The compact arrangement of the pre-cooler jackets is utilized to minimize the footprint of the complete apparatus and facilitate making the apparatus available in portable units. It is to be understood that the arrangement is not critical to the heat exchange function of the pre-cooler, and that other orientations may be used within the scope of the invention.

Although the invention is not limited to any particular temperature change in the pre-cooler, in a typical installation the temperature of the incoming gas is reduced approximately thirty to forty degrees F. For example, if the temperature of the warm gas stream entering the pre-cooler is one hundred degrees F., the temperature of that gas stream exiting the pre-cooler may be expected to be reduced to approximately sixty degrees F.

Figure 3:
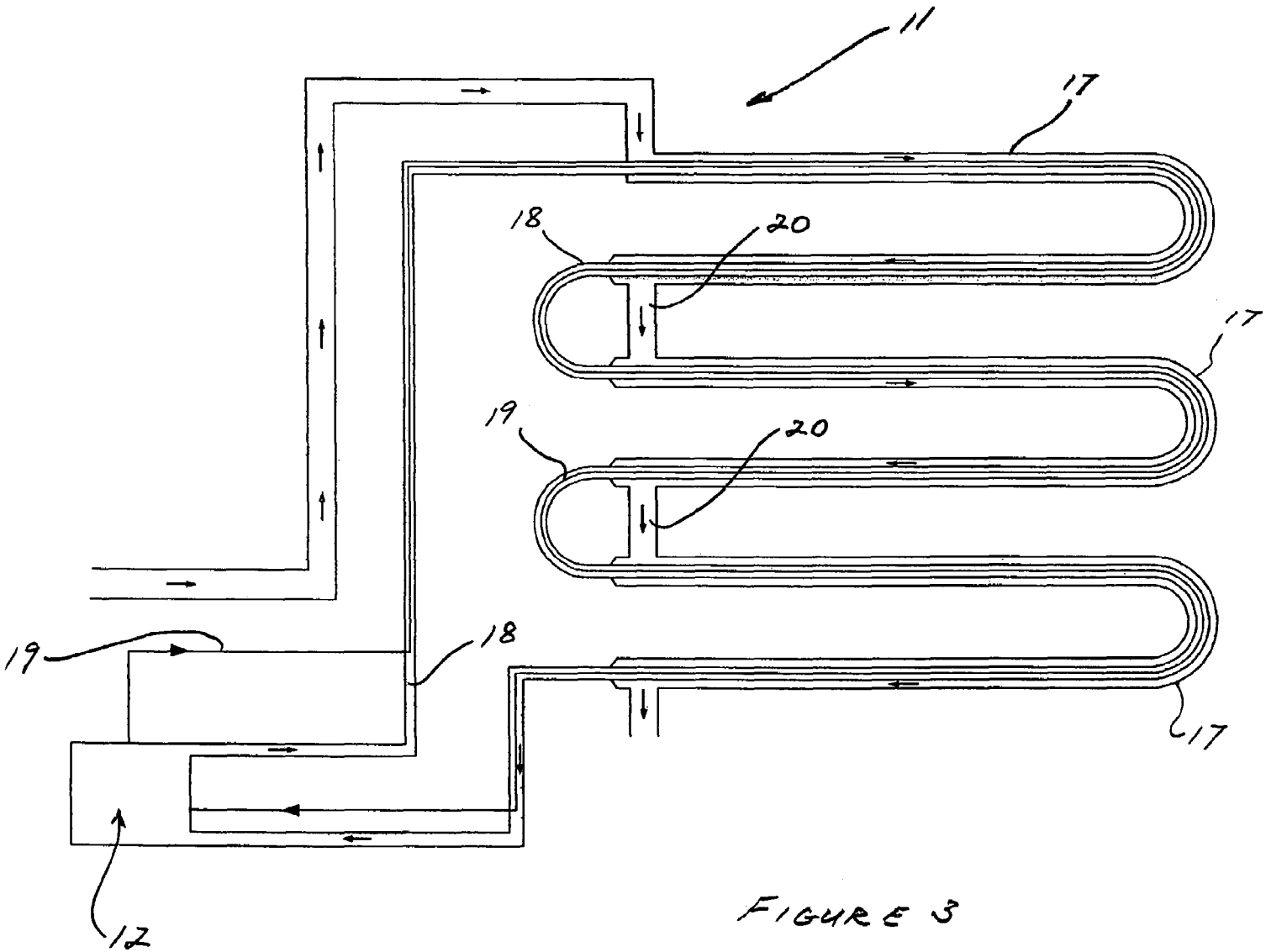
FIG. 3 is a schematic illustration of a preferred embodiment of the chiller assembly of the apparatus of the invention.
Figure 4:
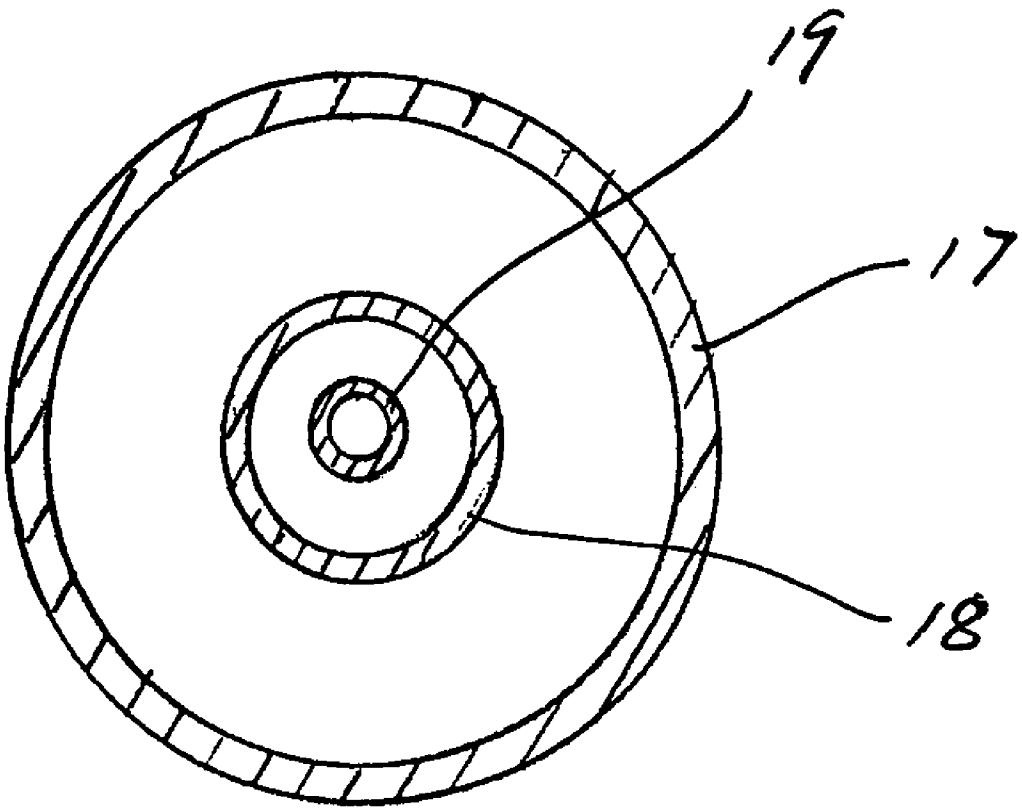
FIG. 4 is a cross-sectioned illustration showing the concentric disposition of the lines carrying the three fluids flowing through the chiller assembly of the apparatus of the invention.

Chiller assembly 11 of the apparatus, illustrated in FIG. 3, comprises an elongate heat exchange assembly, preferably formed in the same general configuration as pre-cooler 10, with a plurality of outerjackets 17, a first refrigerant tube 18, and a second refrigerant tube 19, of smaller diameter than refrigerant tube 18. Refrigerant tube 18 extends through the interior of outerjackets 19 in coaxial relation with jackets 17, and refrigerant tube 19 extends through the interior of refrigerant tube 18 in concentric, coaxial relation with that tube. The coaxial relationship among jacket 17, tube 18, and tube 19 is illustrated in FIG. 4. In the illustrated embodiment each jacket 17 is formed in a narrow U-shaped configuration, joined by short gas conduits 20, similar to conduits 16 in the pre-cooler construction. Refrigerant tubes 18 and 19 preferably extend continuously through each jacket 17 and between jackets. Tubes 18 and 19 are disposed in the interior of jackets 17 through the curvature at the base of the U-shape of each of jackets 17, but do not extend through conduits 20 between jackets. Rather, the refrigerant tubes exit from the end of one of the legs of the U-shaped jacket and enter the end of the adjacent leg of the next jacket, following a smooth curvature between jackets. The configuration and stacked arrangement of jackets and refrigerant tubes in the preferred embodiment of the chiller assembly is used in order to achieve a compact design and facilitate the construction of portable units of the apparatus. Other spacial orientations of the heat exchange components may be used if, for example, portability of the apparatus is not a factor.

The hydrocarbon gas flowing through jackets 17 is cooled by heat exchange between the gas and a first refrigerant in first refrigerant tube 18, through the wall of tube 18. The refrigerant flowing through tube 18 is itself cooled by heat exchange with a second refrigerant in second refrigerant tube 19, through the wall of tube 19. In the preferred embodiment, the flow of gas through the chiller assembly is co-current with the flow of the first refrigerant through tube 18, and the flow of the first refrigerant through tube 18 is also co-current with the flow of the second refrigerant through tube 19.

This two stage cooling is a unique feature of the apparatus and method of the invention, and achieves a significant increase in the efficiency of the system in comparison to single stage refrigerant cooling. There are a number of variables involved in cooling, or removing heat energy from, a first fluid stream in heat transfer contact with a second fluid stream, including the temperature difference between the two fluids, the area of contact between the two streams, and the relative volumes of the two streams. In the present situation, and in chiller assembly 11, two stages of heat transfer occur simultaneously, throughout the chiller assembly. In the first stage the first fluid is the natural gas flowing through jackets 17 and the second fluid is the refrigerant flowing through tube 18. To achieve sufficient cooling of the natural gas to condense hydrocarbons such as propane and butane from the stream in a heat exchanger of reasonable size for use in a wellhead application requires a certain volume of refrigerant, a certain area of contact, and a certain temperature difference, which parameters can be readily determined. The problem inherent in the use of single stage refrigerant systems is efficiently and economically reducing the temperature of the refrigerant sufficiently to provide the required cooling capacity. The use of conventional compressor/condenser technology to achieve the required temperature drop in the required volume of refrigerant is economically impractical.

The present invention overcomes the problem inherent in the use of a single stage refrigeration system by utilizing a second refrigerant heat exchange stage to reduce the temperature of the first refrigerant. As referred to above, in the apparatus of the invention the second refrigerant flowing through tube 19 is in heat exchange contact with the first refrigerant flowing through tube 18, which is in heat exchange contact with the refrigerant flowing through jackets 17. The volume of refrigerant used in the second stage refrigerant system is significantly less than the volume of the refrigerant used in the first stage system, and the volumetric flow rate of refrigerant through second refrigerant tube 19 in the second stage is lower than the volumetric flow rate of refrigerant through first refrigerant tube 18 in the first stage. Accordingly, the capacity of the compressor/condenser equipment required to reduce the temperature of that second stage refrigerant volume to a given temperature is much lower than the capacity that would be required to equivalently reduce the temperature of the higher volume of refrigerant in the first stage.

In the apparatus of the invention, and in accordance with the method, the heat transferred from the natural gas to the first refrigerant, and the heat transferred from the first refrigerant to the second refrigerant, is removed using conventional refrigerant compressor/condenser equipment. In the preferred embodiment, as illustrated in FIG. 3, a two stage compressor/condenser assembly 12 is used to cool the two refrigerant streams. The first stage refrigerant and the second stage refrigerant remain discrete and separate from each other through the compressor/condenser assembly as well as through the chiller assembly. Compressor/condenser assembly 12 may be electrically driven, or may be gas engine driven, depending upon the availability of utilities at the site of operation and upon operator preference.

It has been found that effective and efficient cooling of the natural gas steam for condensation of propane and butane from the gas is achieved with co-current flow of the three fluid streams through chiller assembly 12. In the context of flow characteristics, it is to be understood that the pressures and volumetric flow rates of the three streams are not the same through the chiller assembly. Operating pressures and flow rates may be varied for different apparatus capacities and conditions, to achieve optimum operating efficiencies, as may be determined by routine application of engineering principles.

It will be understood that the cooling of the first stage refrigerant by the second stage refrigerant through the chiller assembly of the apparatus reduces the temperature of the first stage refrigerant and maintains the temperature differential between the first stage refrigerant and the natural gas stream to a significantly greater degree that could be achieved using conventional apparatus and conventional methods. As a result, the apparatus and method of the invention is capable of achieving condensation of hydrocarbons such as propane and butane from the predominantly methane gas stream in the chiller assembly.

Figure 5:
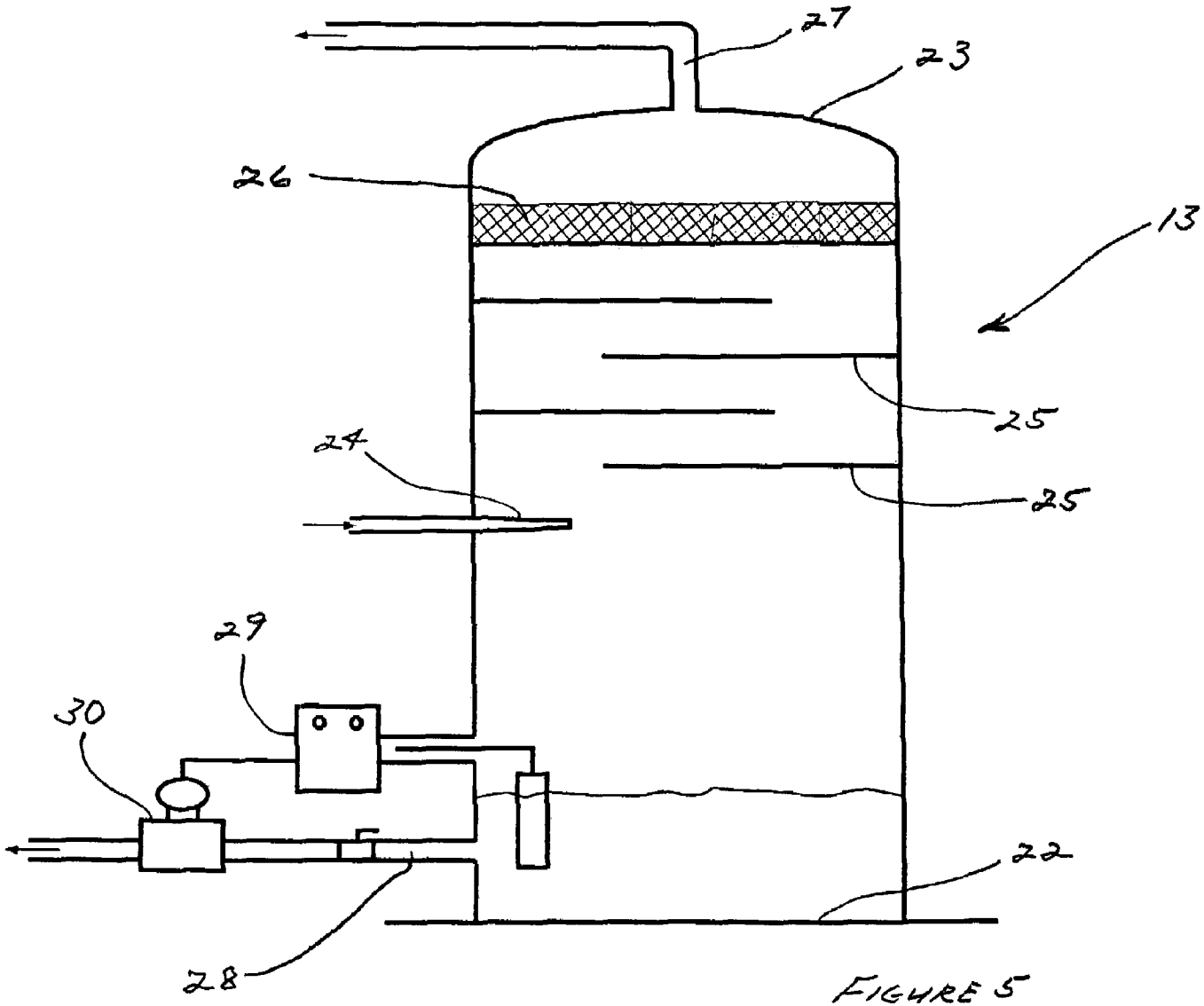
FIG. 5 is a schematic illustration of a preferred embodiment of the separator assembly of the apparatus of the invention.

The stream exiting chiller assembly 11 is routed to separator assembly 13, which is preferably located in close proximity to the outlet from the chiller assembly. Separator assembly 13, illustrated in FIG. 5, comprises a vessel 21 with a substantially hollow interior. The flow from chiller assembly 11 enters vessel 21 approximately midway between the bottom closure 22 and the top closure 23, and is dispersed into the interior of the vessel through flow diverter 24. As the chilled hydrocarbon stream enters the interior of vessel 21 through the flow diverter the liquified constituents of the stream separate from the gaseous hydrocarbons. The gaseous constituents of the gas stream move upward in vessel 21, and the liquid hydrocarbons drop to the bottom of the vessel. The gas moves upward through baffle plates 25 and a mist extractor 26 to assure removal of residual liquids from the gas before the gas exists vessel 21 through outlet 27. Outlet 27 is connected to pipe 15 of pre-cooler assembly 10, and the chilled gas leaving the separator assembly flows through the pre-cooler assembly in heat exchange with warm incoming gas as described above, and exits the apparatus to, e.g., a transmission pipeline.

Liquid hydrocarbons, also referred to as LPG (liquified petroleum gases) in the bottom of vessel 21 are withdrawn from the vessel through liquid outlet 28 to, typically, storage tanks where the LPG is held until collected and transported for sale or use. In the preferred embodiment the level of the LPG in vessel 21 is monitored by a controller 29, through which a pump 30 is automatically activated when the LPG in the vessel reaches a selected level to move the LPG to storage.

The apparatus of the invention is preferably monitored and controlled by an automated control system, including but not limited to controller 29, allowing operation of the apparatus without continuous operator attention.

The apparatus of the invention is readily adaptable to different produced gas flow rates and wellhead conditions. The duration of heat exchange contact between the various fluid streams may be varied by increasing the length of the heat exchanger components and/or by incorporation of additional heat exchange assemblies. For higher gas flows a second chiller assembly and a second compressor/condenser assembly may be added. The gas flow through a second chiller assembly may be routed in sequence from the first chiller assembly, or may be routed to the second chiller assembly in parallel with the first.

The foregoing description of the apparatus and the method of the invention is illustrative and is not intended to be limiting of the scope of either the apparatus or the method. The invention is susceptible to and the scope of the invention as generally defined by the following claims encompasses further variations and alternative embodiment that may be devised on the basis of the description provided herein.

The invention claimed is:

1. Apparatus for condensing a first compound from an entering mixed gas stream including, in gas phase, the first compound and a second compound with a condensation temperature below the condensation temperature of the first compound, and producing the first compound from the apparatus in liquid phase and the second compound from the apparatus in gas phase, comprising, a pre-cooler assembly including an outer jacket for conveying the mixed gas stream entering the apparatus, and an inner pipe extending through said outer jacket for conveying the cooled gas stream exiting the apparatus through the mixed gas stream in separated heat exchange relationship therewith, wherein the mixed gas stream conveyed through said outer jacket is cooled by heat exchange with the gas stream conveyed through said inner pipe;

a chiller assembly including an outer jacket connected to said outer jacket of said pre-cooler assembly in gas flow relationship therewith, said outer jacket of said chiller assembly receiving and conveying the mixed gas stream through said chiller assembly, a first refrigerant line extending through said outer jacket of said chiller assembly, said first refrigerant line conveying a first refrigerant in separated heat exchange relationship with the mixed gas stream, said first refrigerant being at a temperature not greater than the temperature required to condense the first compound from the mixed gas stream, and a second refrigerant line extending through said first refrigerant line, said second refrigerant line conveying a second refrigerant in separated heat exchange relationship with said first refrigerant, said second refrigerant being at a temperature below the temperature of said first refrigerant, wherein heat is transferred from the mixed gas stream to said first refrigerant so as to condense the first compound from the mixed gas stream in liquid phase and leave the second compound in gas phase, and wherein heat from said first refrigerant is transferred to said second refrigerant so as to maintain the temperature of said first refrigerant at a temperature not greater than the temperature required to condense the first compound;

a compressor/condenser assembly connected in refrigerant flow relationship to said first refrigerant line of said chiller assembly and to said second refrigerant line of said chiller assembly, to receive said first refrigerant from said chiller assembly, remove heat therefrom, and return said first refrigerant to said chiller assembly, and to receive said second refrigerant from said chiller assembly, remove heat therefrom, and return said second refrigerant to said chiller assembly;

a separator assembly including a vessel connected to said outer jacket of said chiller assembly in gas flow and liquid flow relationship therewith to receive the first compound in liquid phase and the second compound in gas phase from said chiller assembly and separate such liquid from such gas, a liquid outlet for conveying the first compound in liquid phase from said vessel, and a gas outlet for conveying the second compound in gas phase from said vessel, said gas outlet connected in gas flow relationship to said inner pipe of said pre-cooler assembly;

wherein the volumetric flow rate of said second refrigerant through said second refrigerant line is less than the volumetric flow rate of said first refrigerant through said first refrigerant line.

2. The apparatus of claim 1, wherein said inner pipe of said pre-cooler assembly is disposed in coaxial relationship with said outer jacket of said pre-cooler assembly.

3. The apparatus of claim 2, wherein the flow of the cooled gas stream through said inner pipe is counter-current with the flow of the mixed gas stream through said outer jacket.

4. The apparatus of claim 1, wherein said first refrigerant line of said chiller assembly is disposed in coaxial relationship with said outer jacket of said chiller assembly, and wherein said second refrigerant line of said chiller assembly is disposed in coaxial relationship with said first refrigerant line of said chiller assembly.

5. The apparatus of claim 4, wherein the flow of said first refrigerant through said first refrigerant line is co-current with the flow of the gas stream through said outer jacket of said chiller assembly.

6. The apparatus of claim 5, wherein the flow of said second refrigerant through said second refrigerant line is co-current with the flow of said first refrigerant through said first refrigerant line.

7. Apparatus for condensing at least one hydrocarbon compound from an entering gas stream including, in gas phase, the hydrocarbon compound to be condensed and methane, and producing the condensed hydrocarbon compound from the apparatus in liquid phase and the remainder of the gas stream from the apparatus in gas phase as an exiting gas stream, comprising, a pre-cooler assembly including an outer jacket for conveying the entering gas stream through said pre-cooler assembly, and an inner pipe extending through said outer jacket for conveying the exiting gas stream through the entering gas stream in counter-current flow relative to the entering gas stream and in indirect heat exchange relationship therewith, wherein the entering gas stream is cooled by heat exchange with the exiting gas stream conveyed through said inner pipe;

a chiller assembly including an outer jacket connected to said outer jacket of said pre-cooler assembly in gas flow relationship therewith, said outer jacket of said chiller assembly receiving and conveying the cooled gas stream from said pre-cooler assembly through said chiller assembly, a first refrigerant line extending through said outer jacket of said chiller assembly, said first refrigerant line conveying a first refrigerant in co-current flow relative to the cooled gas stream and in indirect heat exchange relationship with the cooled gas stream, said first refrigerant being at a temperature not greater than the temperature required to condense the hydrocarbon compound to be condensed from the entering gas stream, and a second refrigerant line extending through said first refrigerant line, said second refrigerant line conveying a second refrigerant in co-current flow relationship with said first refrigerant and in separated heat exchange relationship with said first refrigerant, said second refrigerant being at a temperature below the temperature of said first refrigerant, wherein heat is transferred from the entering gas stream to said first refrigerant so as to condense to liquid phase the hydrocarbon compound to be condensed and the remainder of the gas stream remains in gas phase, and wherein heat from said first refrigerant is transferred to said second refrigerant so as to maintain the temperature of said first refrigerant at a temperature not greater than the temperature required to condense the hydrocarbon compound to be condensed;

a compressor/condenser assembly connected in refrigerant flow relationship to said first refrigerant line of said chiller assembly and to said second refrigerant line of said chiller assembly, to receive said first refrigerant from said chiller assembly, remove heat therefrom, and return said first refrigerant to said chiller assembly, and to receive said second refrigerant from said chiller assembly, remove heat therefrom, and return said second refrigerant to said chiller assembly;

a separator assembly including a vessel connected to said outer jacket of said chiller assembly in gas flow and liquid flow relationship therewith to receive the condensed hydrocarbon compound in liquid phase and the remainder of the gas stream in gas phase from said chiller assembly and separate such liquid from such gas, a liquid outlet for conveying the first compound in liquid phase from said vessel, and a gas outlet for conveying the second compound in gas phase from said vessel, said gas outlet connected in gas flow relationship to said inner pipe of said pre-cooler assembly;

wherein the volumetric flow rate of said second refrigerant through said second refrigerant line is less than the volumetric flow rate of said first refrigerant through said first refrigerant line.

8. The apparatus of claim 7, wherein said outer jacket of said pre-cooler assembly comprises an elongate hollow body, and wherein said inner pipe of said pre-cooler assembly extends through said elongate hollow body of said pre-cooler assembly in coaxial relationship therewith.

9. The apparatus of claim 7, wherein said outer jacket of said pre-cooler assembly comprises a plurality of elongate hollow bodies disposed in parallel relationship, connected by a plurality of connector conduits, and wherein said inner pipe of said pre-cooler assembly extends through each of said elongate hollow bodies of said pre-cooler assembly in coaxial relationship therewith.

10. The apparatus of claim 7, wherein said outer jacket of said chiller assembly comprises an elongate hollow body, wherein said first refrigerant line extends through said elongate hollow body of said chiller assembly in coaxial relationship therewith, and wherein said second refrigerant line extends through said first refrigerant line in coaxial relationship therewith.

11. The apparatus of claim 7, wherein said outer jacket of said chiller assembly comprises a plurality of elongate hollow bodies disposed in parallel relationship, connected by a plurality of gas conduits, wherein said first refrigerant line extends through each of said elongate hollow bodies of said chiller assembly in coaxial relationship therewith, and wherein said second refrigerant line extends through said first refrigerant line in coaxial relationship therewith.

12. A method of condensing to liquid phase and removing in liquid phase hydrocarbon compounds from a stream of natural gas including in gas phase the compounds to be condensed, comprising the steps of, chilling the gas stream including in gas phase the compounds to be condensed to a temperature below the condensation temperature of the compounds to be condensed by indirect heat exchange between the gas stream and a first refrigerant having a first temperature below said condensation temperature, so as to condense hydrocarbon compounds to liquid phase from the gas stream;

cooling said first refrigerant by indirect heat exchange between said first refrigerant and a second refrigerant having a second temperature below said temperature of said first refrigerant, simultaneously with said heat exchange between said gas stream and said first refrigerant; and separating condensed hydrocarbon compounds in liquid phase from the remaining gas stream so as to produce an exiting liquid stream of condensed hydrocarbon compounds and an exiting gas stream;

wherein the volumetric flow rate of said second refrigerant is less than the volumetric flow rate of said first refrigerant.

13. The method of claim 12, including the initial step of pre-cooling the gas stream including in gas phase the compounds to be condensed by indirect heat exchange with said exiting gas stream.

14. The method of claim 11, wherein the step of chilling the gas stream is performed in a heat exchange assembly through which the gas stream and said first refrigerant are routed in co-current flow with each other.

15. The method of claim 14, wherein said first refrigerant and said second refrigerant are routed through said heat exchange assembly in co-current flow with each other.

16. The method of claim 13, wherein the step of pre-cooling the gas stream is performed in a heat exchange assembly through which the gas stream and said exiting gas stream are routed in counter-current flow with each other.

17. The method of claim 15, wherein said first refrigerant is routed through a first refrigerant line and said second refrigerant is routed through a second refrigerant line, and wherein said second refrigerant line is disposed within said first refrigerant line in coaxial relationship therewith.

18. The method of claim 17, wherein the gas stream is routed through an outer jacket, and herein said first and second refrigerant lines are disposed within said outer jacket in coaxial relationship therewith.

* * * * *